United States Patent [19]

Shibano

[11] Patent Number: 4,819,030

[45] Date of Patent: Apr. 4, 1989

[54] CLEANING DEVICE FOR CLEANING TONER IMAGE CARRIER

[75] Inventor: Tomobumi Shibano, Kawasaki, Japan

[73] Assignee: Ricoh Company, Ltd., Tokyo, Japan

[21] Appl. No.: 131,995

[22] Filed: Dec. 11, 1987

[30] Foreign Application Priority Data

Dec. 17, 1986 [JP] Japan ..... 61-298974

[51] Int. Cl.[4] ..... G03G 15/08; G03G 15/00

[52] U.S. Cl. ..... 355/15; 355/3 DD

[58] Field of Search ..... 355/15, 3 DD; 118/652

[56] References Cited

U.S. PATENT DOCUMENTS 4,218,131 8/1980 Ito et al. ..... 355/15

4,251,155 2/1981 Schnall et al. ..... 355/15

4,522,487 6/1985 Misawa ..... 355/15

*Primary Examiner*—A. C. Prescott

*Assistant Examiner*—Jane Lau

*Attorney, Agent, or Firm*—Cooper & Dunham

[57] ABSTRACT

A cleaning device adapted to be detachably mounted on an electrostatic printing apparatus etc. for removing by means of a cleaning blade etc. extra toner left on a photosensitive member of the printing apparatus for storage in a toner recovery tank is disclosed, in which the cleaning blade etc. is moved to seal an opening of the toner recovery tank when the cleaning device is detached from the photosensitive member.

6 Claims, 5 Drawing Sheets

CLEANING DEVICE FOR CLEANING TONER IMAGE CARRIER

FIELD OF THE INVENTION

The present invention relates to a cleaning device for removing toner left on a toner image carrier and, particularly, to such device capable of being removably attached to the toner image carrier. The cleaning device can be used advantageously in an electrostatic recording device such as electrostatic copying machine, laser printer and facsimile machine.

RELATED ART STATEMENT

In the conventional electrostatic recording device, a photosensitive member is usually used as a toner image carrier on which a toner image is formed and a copy paper is fed toward the photosensitive member according to the known electrostatic photographic process. The toner image on the photosensitive member is transferred onto the copy paper by electric discharge caused by a transfer charger disposed oppositely to the photosensitive member. The copy paper bearing the transferred image thereon is peeled off from the photosensitive member and carried to a fixing device in which the toner image is fixed on the copy paper, completing a recording.

It is usual, however, that a portion of toner is left on the photosensitive member even after the toner image is transferred onto the copy paper. The residual toner on the photosensitive member is usually removed by means of a cleaning device having a cleaning member such as cleaning blade. Such cleaning device is associated with a toner recovery tank having a toner recovery opening through which toner removed from the photosensitive member is recovered for storage therein.

With repetition of the electrostatic recording process, an amount of toner in the toner recovery tank increases and it becomes full finally at which time the cleaning device is detached from the photo-sensitive member and substituted by a new cleaning device having an empty tank. In the conventional device, when the cleaning device whose recovery tank is full is detached from the photo-sensitive member, toner in the tank tends to flow out through the opening, resulting in contamination of an inside and/or outside portions of the electrostatic recording device.

OBJECT AND SUMMARY OF THE INVENTION

An object of the present invention is to provide a cleaning device for an electrostatic recording device, by which flowing-out of toner through a toner recovery opening of a toner recovery tank thereof when the cleaning device is detached from a photo-sensitive member and hence the electrostatic recording device is prevented effectively.

In order to achieve the above object of the present invention, a cleaning device according to the present invention which is adapted to be detachably mounted to an electrostatic recording device comprises a toner recovery tank having an opening forming an upper edge of the tank and opposing to a full width of a toner image carrier and a lower edge in contact with a peripheral surface of the toner image carrier, a cleaning member mounted on the upper edge of the tank and in pressure contact with the toner image carrier and means for moving the cleaning member automatically toward the lower edge of the tank, during a time in which the cleaning device is detached from the toner image carrier, to close the opening with the cleaning member.

DETAILED DESCRIPTION OF THE PREFERRED EMBODIMENTS

Figure 1:
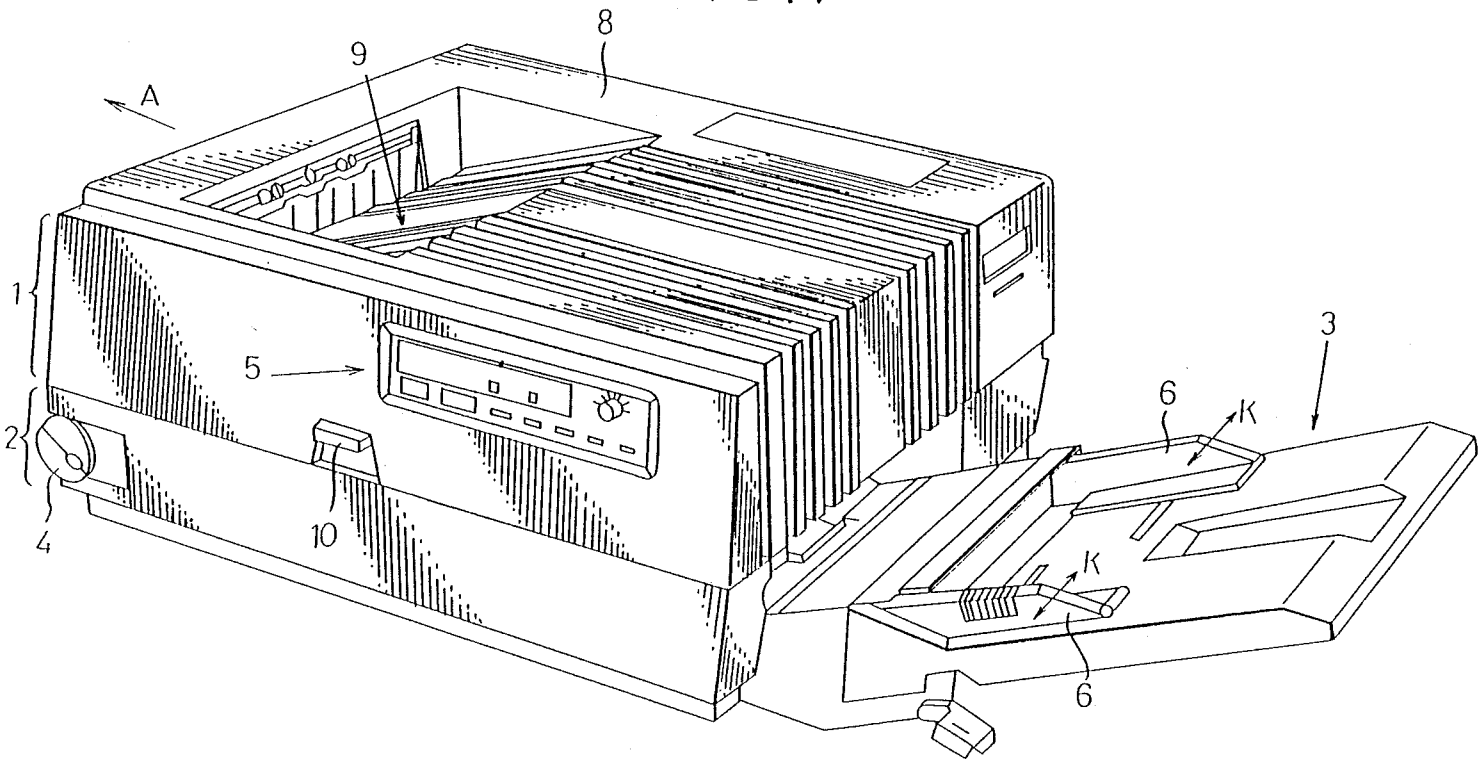
FIG. 1 is a perspective view of a laser printer which is an example of an electrostatic recording device to which a cleaning device according to the present invention is applicable.

FIG. 1 shows an outer configuration of a laser printer which is an example of an electrostatic recording device. The laser printer responds to instructions from a host computer which is not shown to print characters and/or symbols on a transfer member such as paper sheet or envelope etc. The laser printer is generally composed of an upper unit 1 and a lower unit 2. A paper feed tray 3 is detachably mounted on the lower unit 2 which is also provided with a discharge switch knob 4. The upper unit 1 is provided with an operation panel 5 on which are located various switches etc. for setting printing conditions such as size of transfer member etc. An upper surface of a cover 8 which is one of the constituents of the upper unit 1 constitutes an upper discharge tray 9.

The transfer members on which the printing operations are to be performed are stacked on the feed tray 3. In the embodiment, it is possible to print image on transfer members of any size in a range from legal size to smaller envelope size by regulating guide plates 6 on the feed tray 3 in directions shown by a double arrow K. The guide plates 6 are linked below the tray so that when one of the guide plate is moved in either direction the other guide plate moves in the other direction automatically. The switch knob 4 functions to decide whether a transfer member on which a toner image is transferred is to be discharged to the upper discharge tray 9 or leftwardly along an arrow A externally of the device.

Figure 2:
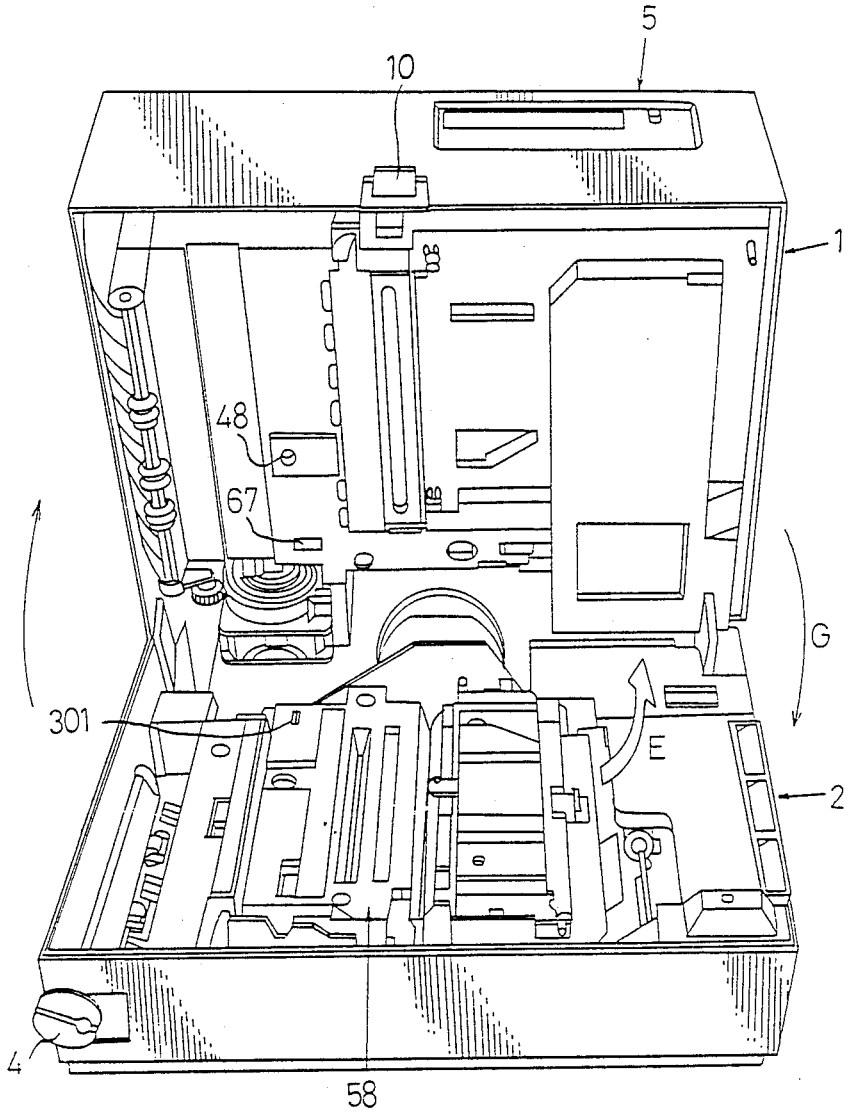
FIG. 2 is a perspective view of the laser printer in FIG. 1 with an upper unit of the laser printer is opened.

The upper unit 1 and the lower unit 2 are hinged in a rear side of the device and locked in a closed state by a locking mechanism provided in a front side thereof. By releasing the locking mechanism by pushing up a lock lever knob 10 protruding from a front surface of the cover 8, the upper unit 1 can be opened with respect to the lower unit 2 as shown in FIG. 2. The separate upper and lower units which are movable to each other facilitate maintenance of the laser printer including an exchange of photo-sensitive members to be described later.

Figure 3:
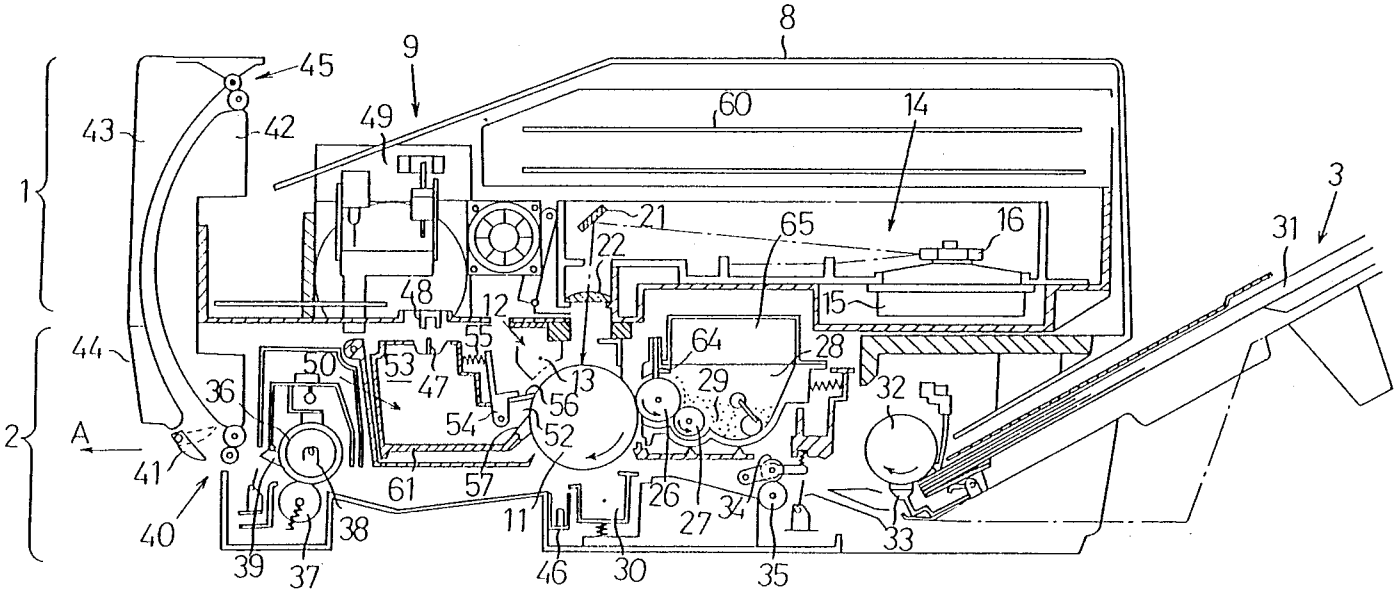
FIG. 3 is a cross section of the laser printer.

FIG. 3 is a cross section of the laser printer with the upper and lower units 1 and 2 being locked in the closed state. An operation of the laser printer will be described briefly with reference to this figure.

Figure 4:
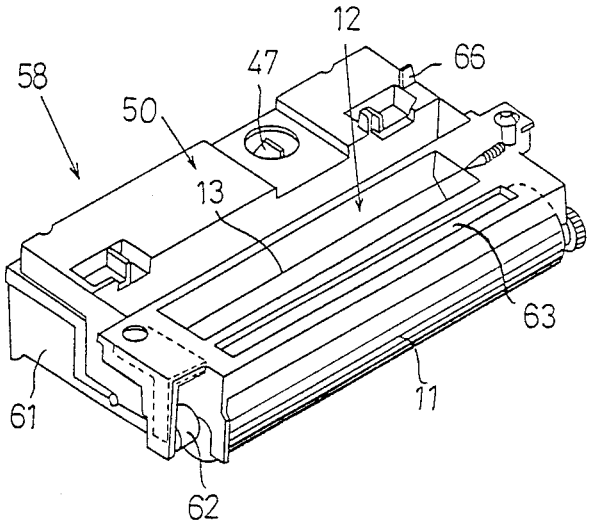
FIG. 4 is a perspective view of an example of a unit including a cleaning device.

The photo-sensitive member 11 in the form of drum disposed around a center of the lower unit 2 is rotated in clockwise direction and subjected to electric discharge by a charger 12. A charge wire 13 of the charger 12 is stretched in parallel with the drum 11 as shown in FIG. 4 so that a surface of the drum 11 is charged uniformly in an axial direction by electric discharge by the charge wire 13.

Figure 5:
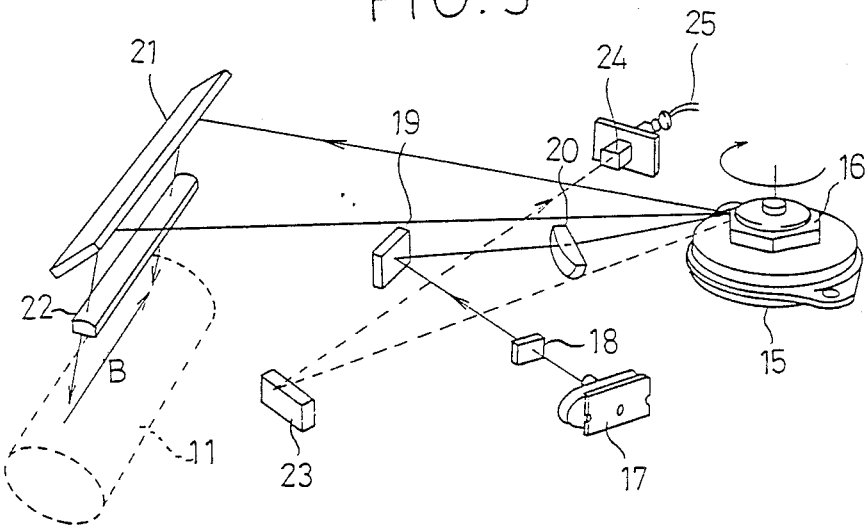
FIG. 5 is a perspective view of an example of a laser exposing device.

The drum 11 having the surface charged is exposed with image light by a laser exposure 14. In FIG. 5, a laser diode (LD) is provided in a laser diode (LD) unit 17 of the laser exposure 14 and emits laser beam for writing an image signal from the host computer. The laser beam passes through a first cylindrical lens 18 and is reflected by a first mirror 19 to a spherical lens 20 by which it is converged and refracted upwardly by about 5 degrees in angle. Then it is reflected by one of faces of a polygonal mirror 16 which is being rotated by a scanner motor 15 and passes above the spherical lens 20 to a second mirror 21. The laser beam reflected by the second mirror 21 passes through a second cylindrical lens 22 to the surface of the drum 11 to expose the latter dot by dot. Since the polygonal mirror 16 is rotating, the laser beam scans the second mirror 21 and hence the drum 11 in a direction shown by an arrow B to perform a main scan. With this main scan, a line of dots is formed on the drum by the laser beam. This optical scan is repeated every face of the polygonal mirror 16 while the drum 11 rotates in a direction (subscan direction) perpendicular to the main scan direction. As a result, an electrostatic latent image corresponding to the image signal is formed on the surface of the drum 11. In this embodiment, the main and sub scans are performed such that dot density of the electrostatic latent image becomes 300 dots/inch. When a printing is performed on the basis of such high density dot image, it is possible to obtain a print image having sharpness as high as that obtainable according to a printer of the so-called font impact type. In this embodiment, each face of the polygonal mirror 16 is curved such that a scan image plane on the second mirror 21 becomes flat. Therefore, a necessity of the so-called f-$\theta$ lens to be disposed between the polygonal mirror 16 and the second mirror 21 is removed and thus it becomes possible to substantially minimize the laser optical device 14 as a whole.

The LD of the LD unit 17 produces a synchronizing laser beam once every scan in addition to the generation of the laser beam for image signal writing. The synchronizing beam is reflected by the polygonal mirror 16 and passes through a third mirror 23 and a third cylindrical lens 24 to an optical fiber 25 connected to a main controller including a micro computer for controlling a whole operation of the printer. The main controller responds to the synchronizing laser beam transmitted through the optical fiber 25 to control a timing of generation of the laser beam for image signal writing.

Again, in FIG. 3, the electrostatic latent image formed on the drum 11 by means of the laser exposure 14 is transported to a developing roller 26 with an advance of rotation of the drum 11. Since this embodiment is based on the so-called contact development system, the developing roller 26 is rotated in counterclockwise direction while contacting with the drum 11 lightly. Non-magnetic toner 29 stored in a developing tank 28 is fed to the developing roller 26 by a toner supply roller 27 disposed in a bottom portion of the developing tank 28 and rotating in counterclockwise direction. Therefore, the electrostatic latent image on the drum 11 reaching the developing roller 26 is developed with toner carried by the developing roller 26 to provide a visible image. In the contact developing system, the developer is a single constituent developer based on non-magnetic toner and thus it is unnecessary to use magnetic toner. That is, preparation of toner is very easy. Further, since any carrier is not used, a carrier exchange which is unavoidable in the conventional device using a developer containing two constituents can be eliminated. Furthermore, since non-magnetic toner can be easily fixed, it is possible to constitute a fixing device having compact and simple structure.

Further, with non-magnetic toner, a contour of developed toner image can be made sharp and it is possible to obtain an image of higher quality compared with that developed with a single component, magnetic toner.

The toner image is transported to a transfer position facing to a transfer charger 30. Reference numerals 64 and 65 depict a toner layer thickness regulating blade and a toner cartridge, respectively.

While the above process is being performed, an uppermost one of the transfer materials 31 such as paper sheets stacked on the feed tray 3 is separated from others by a feed roller 32 rotating clockwisely and a friction pad 33 in pressure contact therewith and sent in between nip portions of an upper conveyor roller 34 and a lower conveyor roller 35 by which the uppermost sheet is conveyed to the transfer position of the drum 11.

The transfer paper conveyed in this manner is overlapped on the toner image on the drum 11 at the transfer position and subjected to electric discharge by the transfer charger 30. With the electric discharge, the toner image on the drum 11 is transferred onto the transfer paper, completing the transfer operation. After this transfer operation, the drum 11 together with the transfer paper overlapped therewith is irradiated with light from a charge removing lamp 46 comprising a LED disposed adjacent to the transfer charger 30 through the transfer paper to remove surface potential of the drum passing through the position of irradiation by the charge removing lamp 46, so that electrostatic attractive force between the drum and the transfer paper is reduced, allowing the latter to reliably be separated from the drum surface by gravity. The transfer paper separated from the drum 11 is sent to a heat fixing device having a heater roller 36 and a pressure roller 37. The transfer paper together with the toner image transferred thereonto is pressed by the rollers 36 and 37 while being heated by the heating roller 36 to thereby melt-fix the toner image on the transfer paper. Heating by the heater roller 36 is realized by a heater 38 provided within the heating roller 36.

The transfer paper, after the fixing operation, is peeled off from the heating roller 36 by means of a peeling nail 39 and sent to the discharge roller 40. A discharge switch nail 41 is provided downstream of the discharge roller 40, which is switched between positions shown by a solid line and a dotted line in FIG. 3 by rotating the discharge switch knob 4 shown in FIG. 1 or 2. When the switch nail 41 is in the position shown by the solid line, the transfer paper from the discharge roller 40 is guided through a conveyor path defined by a guide member 42 and guide plates 43 and 44 to the upper discharge tray 9 by means of a discharge roller 45. On the other hand, when the nail 41 is in the position shown by the dotted line, the transfer paper from the discharge roller 40 is discharged straightly along the arrow A.

The switch knob 4 is mannually operated so that the discharge direction can be selected by an operator. When a plurality of usual thin transfer papers are to be printed and to be stacked according to page number, it is preferrable to discharge them to the discharge tray 9. On the other hand, when relatively thick papers such as envelopes are to be printed, it is usual to discharge them straightly.

Extra toner may be left on the photosensitive drum 11 after the transfer operation is completed. Electric charge on such extra toner is removed, together with the drum 11, by the charge removing lamp 46 and extra toner is removed from the drum surface by the cleaning device 50. The photosensitive drum 11 cleaned by the cleaning device 50 is subjected to charging by the charger 12, again.

The printing process mentioned above is controlled by the main controller 60 having a micro computer and arranged in an upper left portion of the printer.

In this embodiment, the photosensitive drum 11, the charger 12 and the cleaning device 50 shown in FIG. 3 constitute a single unit (photosensitive member unit 58) as shown in FIG. 4, which is mounted removably on the printer. The cleaning device 50 comprises a toner recovery tank 52 having an opening 52 facing to the photosensitive drum 11 throughout the width thereof as shown in FIG. 3, a cleaning blade 56 mounted to a blade holder 54 rotatably supported by an upper edge of the toner recovery tank and having a front end held in pressure contact with the outer periphery of the photosensitive drum 1 by a compression spring 55 mounted on the blade holder 54 and a seal member 57 mounted on a lower edge of the toner recovery tank 53 and having a front end held in pressure contact with the photosensitive drum 11. With the cleaning device 50 constructed as above mentioned, extra toner on the photosensitive drum 11 is moved by the cleaning blade 56 and stored in the toner recovery tank 53 as waste toner.

The photosensitive member unit 58 is housed in a casing 61 with a rotary shaft 62 of the photosensitive drum 11 being rotatably and removably supported by the casing 61 as shown in FIG. 4. The casing 61 is formed with a hole 63, laser beam from the laser optical device 14 (FIG. 3) being directed therethrough. The casing 61 itself defines the toner recovery tank 53 (FIG. 3) and a casing, i.e., a wall surrounding the charge wire 13, for the charger 12. The cleaning blade 56 is supported by the casing 61. The photosensitive drum 11 is removably mounted on the casing 61 and hence the toner recovery tank 53 for reasons to be described subsequently. That is, it is usual to replace the toner recovery tank 53 when the latter is fully filled by waste toner. In such case, if the toner recovery tank 53 is integrally provided with the photosensitive drum 11, the latter must be replaced together with the tank 53. The life time of the photosensitive drum 11 is substantially elongated recently due to improvements of material and manufacturing process and it is durable for, for example, 20,000 prints. Therefore, when it is intended to use the photosensitive drum 11 for the full duration, a very large toner recovery tank becomes necessary, causing the printer itself to be very large. In order to avoid this problem, according to the present invention, the toner recover tank is made exchangeable with respect to a photosensitive drum. Thus, the printer can be compact while allowing the photosensitive drum to be used for its full life. A time at which the toner recovery tank should be replaced may be determined according to any of various control schemes and an example thereof will be described subsequently.

In FIG. 3, a feeler 47 is mounted on an upper surface of the toner recovery tank 53. When the toner recovery tank 53 is completely filled with extra toner collected from the photosensitive drum 11, the feeler 47 is pushed up by extra toner in the tank. A toner-over sensor 48 composed of an optical sensor is arranged above the feeler 47 and detects the feeler 47 pushed up to supply a sensing signal to the main controller 60 including the micro computer.

A counter 49 is further provided above the toner over sensor 48, which functions to count the number of prints every cleaning unit including the toner recovery tank 53 in the photosensitive member unit 58 (FIG. 4) and the cleaning blade 56 etc. The counter 49 responds to transfer instruction signal (instructing an execution of transfer by means of the transfer charger 30) from the main controller 60 to perform the count-up operation and, when its count reaches 10,000 counts, provides a signal indicating the fact to the main controller 60. The main controller 60 respohnds to the signal to instruct the operation panel 5 to make a display showing an exchange of the photosensitive member unit. When the toner over sensor 48 detects the feeler 47 before the count of the counter 49 does not reach 10,000 and the detection signal is sent to the main controller 60, the same display is made on the operation panel.

On the other hand, in FIG. 4, an identification projection 66 is formed on the upper surface of the casing 61 of the photosensitive member unit 58 including a new photosensitive drum 11 for identifying the unit. The projection 66 is detected by a type sensor 67 provided on a bottom surface of the printer unit 1. When the display indicating the exchange of photosensitive member unit is made while the projection 66 is detected by the type sensor 67, i.e., when the photosensitive drum 11 is not used 10,000 times as yet, a display "1" is made together with the display indicating the exchange.

The display "photosensitive unit exchange "1"" indicates the use of 10,000 times of the photosensitive drum for convenience. Although there may be a case where toner over occurs before 10,000 counts, the toner recovery tank 53 is usually designed to have a capacity to be completely filled with waste toner when 10,000 prints are performed. Therefore, when the display "photosensitive unit exchange "1"" is given by the toner over detection prior to 10,000 counts, it is deemed that the photosensitive drum has been used 10,000 times substantially. Upon the displays, an operator replaces the cleaning unit of the photosensitive member unit 58. Since the life time of the photosensitive drum 11 is usually a use of 20,000 times, it is not replaced at this stage. The drum 11 is disassembled from the photosensitive member unit 58 to allow the cleaning unit alone to be disposed.

In exchanging the cleaning unit, a photosensitive drum 11 which was used 10,000 times is mounted on a new photosensitive unit 58 having an empty toner recovery tank 53 instead of an old unit 58 having a full toner tank and the new unit 58 is mounted on the lower printer unit 2. A casing 61 of the new photosensitive unit which has no projection 66 is selected. Then, the operator resets the counter 49 by depressing a reset lever preliminarily provided on the counter 49, so that the counter 49 starts its counting from 0 again.

A next display of photosensitive unit exchange is made when the counter counts 10,000 or a toner over is detected. However, since there is no projection 66 for unit identification, the type sensor 67 can not detect it. Therefore, the display in this case shall be "photosensitive unit exchange "2"". This display means that the unit exchange was made twice, i.e., the photosensitive drum was used 20,000 times or certain times close to 20,000 times, indicating an end of the photosensitive drum life. Upon this display, the operator exchanges the whole of the photosensitive unit 58 by a new unit.

Figure 6:
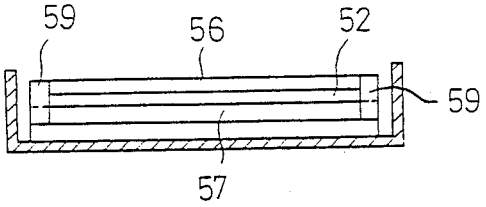
FIG. 6 is a front view of an opening of a cleaning device according to the present invention.

As mentioned hereinbefore, according to the present invention, the cleaning device 50 is detachably mounted on the photosensitive drum 11 with front end of the cleaning blade 56 and the front end of the seal member 57 being held in pressure contact with the peripheral surface of the photosensitive drum 11 when the cleaning device 50 is positioned in the normal position facing to the photosensitive drum 11. On the other hand, a longitudinal end of the cleaning device 50 is sealed by a side seal member 59 as shown in FIG. 6. With such construction, the toner recovery tank 53 provided within the cleaning device 50 is sealed, preventing waste toner from leaking out.

Figure 7:
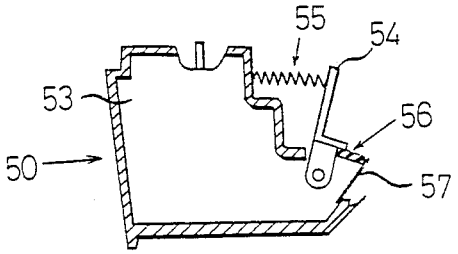
FIG. 7 is a cross section of an example of the cleaning device according to the present invention.

As mentioned before, when the cleaning device 50 is detached from the photosensitive drum 11 for the reason of the toner recovery tank 53 fully filled with waste toner, etc., the blade holder 54 is moved clockwise direction by the pressure spring 55 as shown in FIG. 7 and the front end of the cleaning blade 56 abuts the end of the sealing member 57 with a gap of 0–1 mm to substantially seal the toner recovery tank 53. Therefore, there is no leakage of waste toner from the cleaning device 50.

The pressure spring 55 may have a relatively short free length when it is intended to merely abut the cleaning blade 66 to the drum 11. In this embodiment, however, since the spring 55 is adapted to abut the blade 56 to the sealing member 57 in addition thereto, the free length of the pressure spring 55 is made large relatively. The gap between the cleaning blade 56 and the sealing member 57 as small as mentioned above does not affect the effect of prevention of waste toner leakage since waste toner acts as sealing means clogging the gap.

Figure 8:
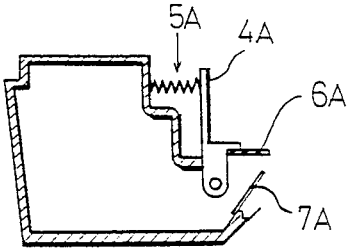
FIG. 8 PRIOR ART
FIG. 8 is a cross section of an example of a conventional cleaning device.

In the conventional cleaning device, since a pressure spring 5A is used to push a blade holder 4A and a cleaning blade 6A, as shown in FIG. 8, the free length thereof is short. Therefore, a gap between an end of the cleaning blade 6A and an end of the sealing member 7A, when the cleaning device is detached from the photosensitive drum, is 3–4 mm. Such gap as large as 3–4 mm can not be clogged by waste toner, resulting in waste toner leakage therethrough and contamination of the printer thereby. On the contrary, according to the present invention, since the sealing condition is kept if the cleaning device is detached from the photosensitive drum, there is no problem of waste toner leakage.

Although, in the described embodiment, the cleaning blade is used as the cleaning member, any other member such as cleaning brush etc. can be used for the same purpose instead thereof. Further, the means for moving the cleaning member toward the lower edge of the toner recovery tank is not limited to the spring 55 and it is possible to provide another spring member separately from the spring 55.

What is claimed is:

1. A cleaning device for an electrostatic printing apparatus having a toner image carrier, said device comprising:

toner recovery tank having an opening opened to the toner image carrier throughout a full width thereof, and having an upper edge and a lower edge, and being detachable with respect to the toner image carrier;

a seal member mounted on a lower edge of the toner recovery tank and having a front end disposed for pressure contact with the toner image carrier;

a cleaning member rotatably mounted on an upper edge of the toner recovery tank and having a front end disposed for pressure contact with said toner image carrier; and driving means for moving said cleaning member to rotate toward said seal member to bring said cleaning member into contact with said seal member for closing said opening of said toner recovery tank such that said opening of said toner recovery tank is closed by means of said cleaning member and said seal member when said toner recovery tank is detached from said toner image carrier.

2. A cleaning device as claimed in claim 1, wherein the toner recovery tank is attachable to the toner image carrier, and wherein said driving means comprises a spring disposed and arranged for also forcing said cleaning member against the toner image carrier to hold said front end of said cleaning member in pressure contact with the toner image carrier when said toner recovery tank is attached to the toner image carrier.

3. A cleaning device as claimed in claim 2, wherein said spring is a compression spring acting between said toner recovery tank and said cleaning member.

4. A cleaning device as claimed in claim 1, further including a blade holder rotatably supported by the upper edge of the toner recovery tank and on which said cleaning member is fixed; and wherein said driving means comprises a spring, disposed between said toner recovery tank and said blade holder, for rotating said blade holder such that said front end of said cleaning member comes in pressure contact with the toner image carrier when said tner recovery tank is attached to the toner image carrier, and such that said cleaning member comes in contact with said seal member when said toner recovery tank is detached from the toner image carrier.

5. A cleaning device as claimed in claim 1, wherein said cleaning member is a cleaning blade.

6. A cleaning device as claimed in claim 1, wherein said driving means comprises means for bringing said cleaning member into contact with said seal member as aforesaid such that the front end of said cleaning member abuts the front end of said seal member with a gap of not more than one mm. between them.

* * * * *